United States Patent [19]

Potter

[11] 4,340,985

[45] Jul. 27, 1982

[54] MECHANIC'S TOOL BOX AND HEAD REST

[76] Inventor: John H. Potter, 1237 N. 27 St., Camden, N.J. 08105

[21] Appl. No.: 217,141

[22] Filed: Dec. 16, 1980

[51] Int. Cl.[3] ..... A47G 9/00; A47B 81/00

[52] U.S. Cl. ..... 5/442; 312/DIG. 33

[58] Field of Search ..... 312/DIG. 33; 280/32.6; 5/419, 436, 440, 442, 434; 15/258

[56] References Cited

U.S. PATENT DOCUMENTS

| | | | |
|---|---|---|---|
| 926,563 | 6/1909 | Mobson | 5/440 |
| 1,104,398 | 7/1914 | Zimmbrman | 280/32.6 |
| 1,764,757 | 6/1930 | Slre | 5/419 |
| 2,293,530 | 8/1942 | Breemler | 5/442 |
| 2,817,857 | 12/1957 | Mockrnsmith | 5/440 |
| 4,266,835 | 5/1981 | Schmidt | 312/DIG. 33 |

*Primary Examiner*—Alexander Grosz

*Attorney, Agent, or Firm*—Berman, Aisenberg & Platt

[57] ABSTRACT

A tool box having a built-in head rest for use by a mechanic when working under low machinery. The article itself comprises a container for tools having a head rest mounted on the top surface of the container.

3 Claims, 3 Drawing Figures

MECHANIC'S TOOL BOX AND HEAD REST

FIELD OF THE INVENTION

This invention relates to a mechanic's tool box having an integral head rest. The tool box is useful for holding tools while working overhead in a prostrate position under low machinery and allows an individual to rest his head on the tool box and withdraw tools are necessary.

BACKGROUND OF THE INVENTION

The prior art shows examples of articles combined with head rests. In U.S. Pat. No. 1,707,766 issued to Page on Apr. 2, 1929 is shown a combination pillow and vanity case. In Page, a generally rigid, oblique and hollow body portion has pillow segments formed on the outside surface to allow an individual to use the container as a pillow. Inside the hollow portion of the article is a container for carrying powder, perfume and other personal use items. This article functions both as a pillow and a vanity container.

An example of a tool box having a generally trapezoidal cross section is shown in U.S. Pat. No. 3,092,428 issued to Kerschner on June 4, 1963. The tool box disclosed in Kerschner has a generally trapezoidal cross section and has peg boards on each inclined side to hold tools for ready retrieval and use.

None of the prior art references cited disclose an apparatus for use by a mechanic to work overhead on low lying equipment. The apparatus disclosed herein conveniently combines a head rest and a tool box to allow a mechanic to retrieve tools for use and provides a clean place to rest his head to alleviate any strain on his neck.

SUMMARY OF THE INVENTION

It is an object of this invention to provide a convenient device for use by a mechanic working under low lying machinery.

It is another object of this invention to provide a container to hold tools or parts for use by a mechanic while working under low machinery.

It is a further object of this invention to combine a tool box and head rest to allow a mechanic to rest his head while working under low lying machinery and have a convenient place to store tools for immediate use and to retrieve tools put in the tool box.

It is a further object of the present invention to provide a tool box and head rest having separate compartments to be used to store spare parts or tools in a segregated area and to allow convenient retrieval while the mechanic is in an inclined position resting on the head rest.

It is a further object of this invention to provide a tool box having an integral head rest to allow a mechanic to rest his head on the tool box while working on low lying machinery wherein the tool box has open sides and back to allow access to tools stored therein by the mechanic by reaching over his head.

These and other objects are attained and achieved by a container having open sides and back having a head rest mounted on the top surface of the container.

BRIEF DESCRIPTION OF THE DRAWINGS

The features that are considered characteristic of the invention are set fourth with particularity in the appended claims. The invention itself, however, both as to its organization and its method of operation, together with additional objects and advantages thereof, will best be understood from the following description of a specific embodiment, when read in connection with the accompanying drawings, wherein like reference characters indicate like parts throughout the several figures, and in which:

BRIEF DESCRIPTION OF THE PREFERRED EMBODIMENT

Figure 1:
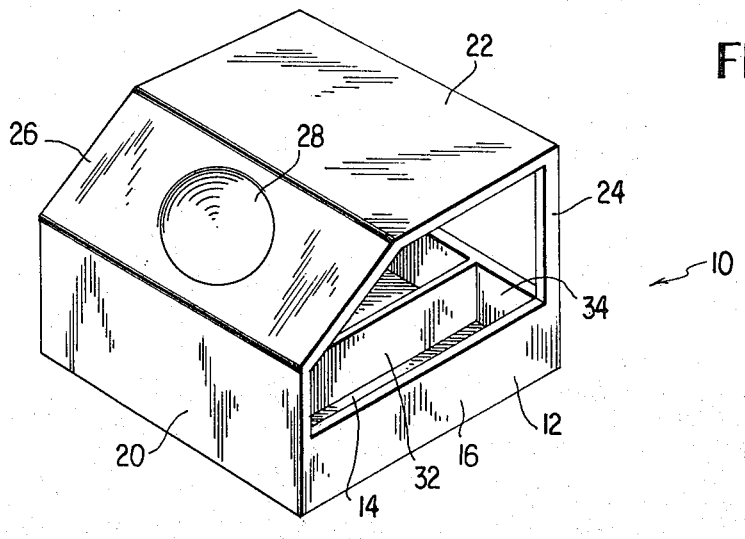
FIG. 1 is a perspective view of a head rest/tool box according to the present invention.
Figure 2:
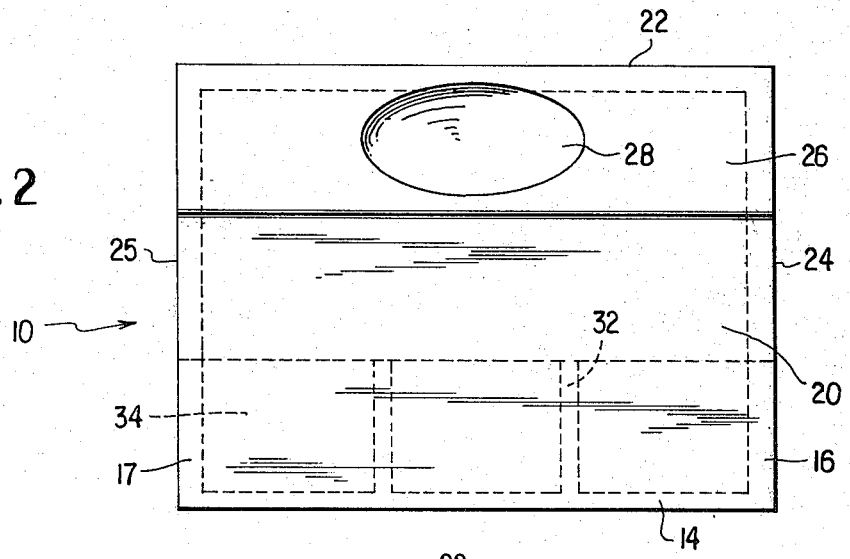
FIG. 2 is a front elevational view of the head rest/tool box of the present invention showing component parts in phantom lines.
Figure 3:
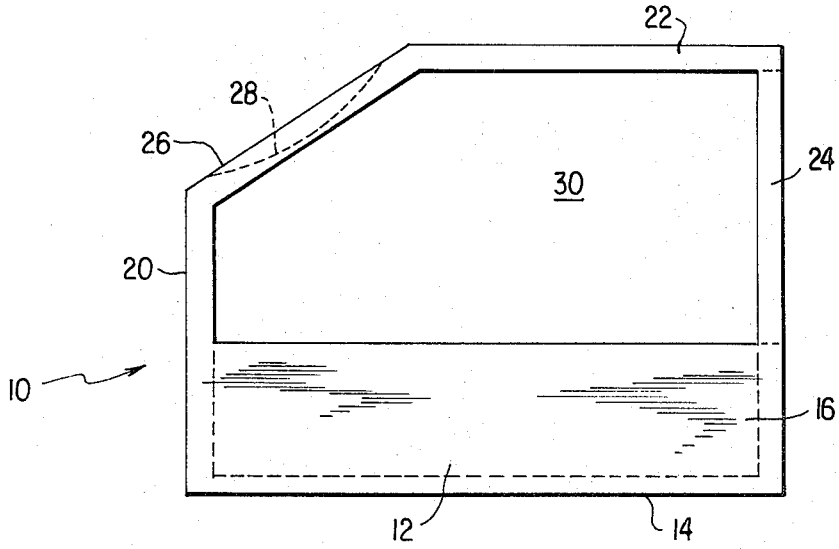
FIG. 3 is a side elevational view of the head rest/tool box of the current invention.

Referring now to the drawings, FIG. 1 shows a perspective view of the head rest/tool box. In FIG. 1, tool box 10 is shown having a container 12 for holding spare parts, tools or other objects for use in maintenance of low equipment. Tool container 12 has a bottom 14 and side walls 16 and 17 which enclose a space for containing tools or spare parts as desired. Tool container 12 has a front wall 20 connected to bottom member 14. A top cover 22 is connected to the tool container 12 by pillars 24 and 25 which connect the top cover to the rear portion of the tool container 12. Top cover 22 is connected to front wall 20 by inclined surface 26. Component parts are shown in phantom lines in FIG. 2.

Centrally located in inclined surface 26 is a head depression 28 which comprises a depressed surface area on inclined surface 26 which is at a comfortable height from bottom 14 so that a mechanic laying on his back working directly over his body may rest his head while working. In this regard, front wall 20 is made a sufficient height to allow the mechanic to comfortably rest his head in head depression 28 and provide him with a clear view of what he is working on over his general torso.

Side walls 16 and 17 of the tool box 10 have openings 30 to allow access to the inside of the tool container 12. Side wall openings 30 are sufficiently large to allow a mechanic to retrieve articles from the interior of the container and pull even unwieldy objects, such as wrenches, through the opening for ready use.

Inside the tool container 12 are shown dividers 32 which longitudinally divide the interior portion of the container so that the mechanic may separate the tools or hold portions empty for placing new or used parts for use in maintenance. The backside of the container has a back wall 34 which encloses the tool container 12 to hold tools therein while working. In a particularly preferred mode, tool container 12 comprises a solid bottom member 14 with side walls 16 and 17, front wall 26 and back wall 34 sealingly connected thereto at their mutual edges to contain small parts or any dripping oil from machine parts.

When preparing the tool box of the current invention for use, a mechanic loads the necessary tools and spare parts in the tool container 12 through either the side openings or the back, placing tools in one compartment defined by a divider and clean spare parts in a second compartment defined by a second divider. The tool box is then slid under low lying equipment and the mechanic may crawl under the equipment. When the tool box is positioned near the area requiring attention, the front wall 20 is placed facing the intended work area and the mechanic may lie down and rest his head in depression 28. When properly positioned, he may reach over his head into side wall openings 30 to grab necessary spare parts and tools for use in his maintenance efforts. He can then take parts that replace parts and put the old parts in the container in one of the areas provided as defined by divider 32. Wide side openings 30 allow a mechanic to retrieve tools by reaching over his head and through the opening 30 to grasp them and also to grasp replacement parts. The parts that are being replaced may be placed through the same openings into the tool container 12. In the preferred mode, the side walls 16 and 17, front wall 20 and back wall 34 are sealingly connected to the bottom member 14 and any oil residing in these parts will not leak onto the floor or surface on which the mechanic is working.

Although a certain specific embodiment of the invention has been shown and described, it is obvious that many modifications thereof are possible. The invention, therefore, is not intended to be limited to the exact showing and description therefore, but is considered to include reasonable and obvious equivalents.

What is claimed is:

1. Combination tool box and head rest comprising: a hollow container having a top and a bottom, which are rigidly and fixed with respect to each other, said top wall having a front portion and a horizontal rear portion parallel to said bottom, spaced apart side walls rising from said bottom and terminating at a point spaced from said top so as to form large openings on opposite sides of said container, a front wall extending between and connecting said side walls and said top and bottom, a back wall rising from said bottom and terminating at a point spaced from said top, a pair of pillars extending from intersections of said side walls and said back wall to said top and forming a large opening between said top and back wall, the front portion of said top wall being downwardly inclined and provided with a centrally located depression adapted to receive a human head, and at least one divider having an edge fixed to said bottom and extending between said front wall and said back wall to form a plurality of compartments for containing tools, replacement parts, or the like.

2. The head rest for containing tools of claim 1 wherein said front wall, said side walls, and said back wall are sealed to said bottom so that oil in said compartments cannot leak out.

3. The combination of claim 2 wherein said bottom, said side walls, said back wall, and said front wall are rectangular.

* * * * *